US006091596A

United States Patent [19]

Godfrey et al.

[11] Patent Number: 6,091,596

[45] Date of Patent: Jul. 18, 2000

[54] CONTACTOR AND CONTROLLER FOR A CONTACTOR

[75] Inventors: David Godfrey, Nuneaton; Andrew Jones; Neil Hedley Morris, both of Warks, all of United Kingdom

[73] Assignee: Lucas Industries, plc, United Kingdom

[21] Appl. No.: 09/378,584

[22] Filed: Aug. 20, 1999

Related U.S. Application Data

[62] Division of application No. 08/803,902, Feb. 21, 1997, Pat. No. 5,982,259.

[30] Foreign Application Priority Data

Feb. 21, 1996 [GB] United Kingdom ..... 9603702

[51] Int. Cl.[7] ..... H01H 47/04

[52] U.S. Cl. ..... 361/154; 191/210

[58] Field of Search ..... 361/152–154, 361/160, 166–169.1, 191, 210; 307/64, 85–87; 367/195–202

[56] References Cited

U.S. PATENT DOCUMENTS

| | | | |
|---|---|---|---|
| 4,688,138 | 8/1987 | Nagata et al. | 361/154 |
| 5,377,068 | 12/1994 | Kaylor et al. | 361/154 |
| 5,510,951 | 4/1996 | Briedis et al. | 361/154 |

*Primary Examiner*—Fritz Fleming

*Attorney, Agent, or Firm*—Andrus, Sceales, Starke & Sawall

[57] ABSTRACT

A contactor comprises first and second armatures which are urged towards contact-making positions by first and second windings, respectively. Each of the armatures displaces the other armature from its contact-making position when moving towards its own contact-making position. A controller actuates each of the windings before deactuating the other of the windings.

3 Claims, 4 Drawing Sheets

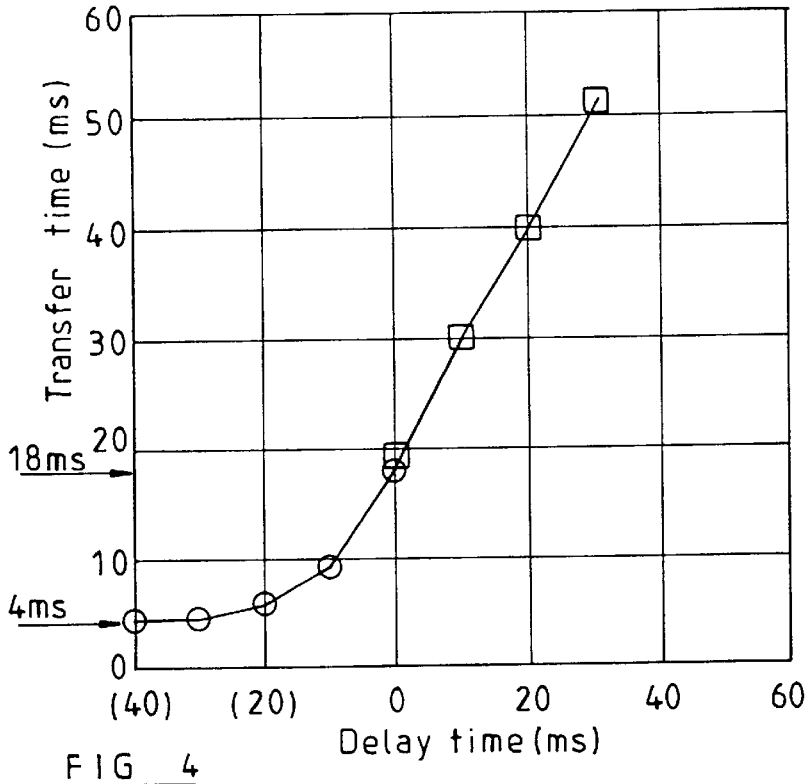
FIG 4
FIG 5
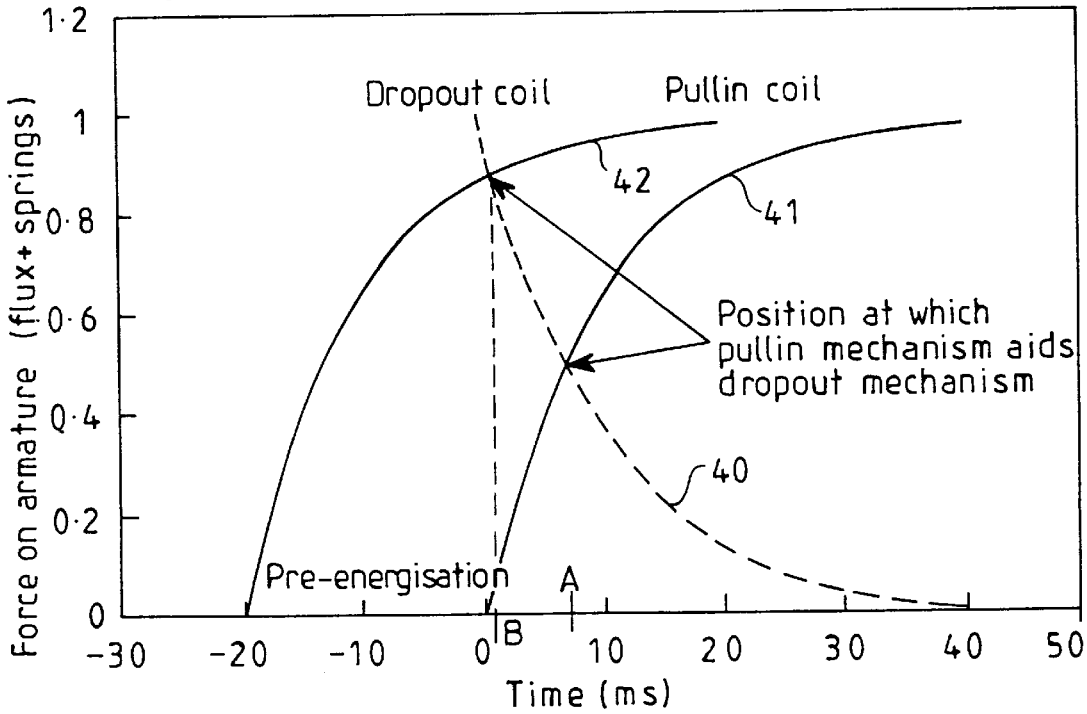

CONTACTOR AND CONTROLLER FOR A CONTACTOR

This application is a division of application Ser. No. 08/803/902, filed Feb. 21, 1997, now U.S. Pat. No. 5,982, 259.

The present invention relates to a contactor and to a controller for a contactor. Such a contactor and controller may be used in AC power supplies for aircraft systems.

There is a requirement in modern aircraft systems to maintain a substantially uninterrupted AC power supply under fault conditions. For instance, when a power supply line is switched from a faulty alternator to a healthy alternator, the change over time i.e. the time during which neither alternator is connected to the power supply line, is typically between 35 and 50 milliseconds. For instance, it typically requires 15 milliseconds for the contacts connecting the power supply line to the faulty alternator to open and 25 milliseconds for the contacts connecting the power supply line to the healthy alternator to close so that a total change over time of 40 milliseconds is typically achieved. These times are typical for switch gear rated at 150 to 600 amps.

A similar problem occurs in a non-fault situation when an aircraft system is switched over from ground power or auxiliary power to a main alternator. Modern avionic equipment cannot cope with an AC power supply interruption of greater than typically 25 milliseconds. For instance, when data is loaded to an on-board computer, the data will not survive an interruption of greater than 25 milliseconds. Thus, data loaded when an aircraft is on the ground with an on-ground electrical supply may be lost during changeover to the aircraft electrical supply.

Although it would be possible to provide an additional DC power supply to overcome this problem, this requires extra weight and complexity.

Another problem occurs during switchover from a faulty alternator to a healthy alternator. If the healthy alternator is switched on before the failing supply is removed, excessive stress may be applied to the alternator drive shafts because the faulty alternator effectively acts as a brake on the healthy alternator. The excessive stress may be sufficient to break an alternator drive shaft. In order to avoid this problem, the faulty alternator must be disconnected before the healthy alternator is connected, which inevitably causes an undesirable break in supply.

When switching from one healthy alternator to another, it is possible for both alternators to be connected simultaneously for a short changeover time period. However, in systems which achieve this, it is necessary to ensure that the frequencies and phases of both alternators are synchronized before switching occurs. This adds complexity and weight to the system.

It is possible to use electronic switching in place of electromechanical switching such as contactors, but such electronic systems have not been developed for typical AC power supply systems, for instance operating at 200 volts AC and a frequency of 400 Hz at the required power levels of 45 to 90 KVA. Further, electronic switching causes problems with heat dissipation in semiconductor switching devices. Hybrid switching systems in which electronic switching is backed up by electromechanical switching have been considered for reducing the heat dissipation problem but this results in increased weight and size, both of which are disadvantageous for avionic systems.

According to a first aspect of the invention, there is provided a contactor comprising first and second armatures and first and second windings for urging the first and second armatures towards respective contact-making positions, each of the first and second armatures being arranged, when urged by the respective one of the first and second windings to the contact-making position, to displace the other of the first and second armatures away from the contact-making position.

The first and second armatures may be pivoted for pivotal movement towards and away from the contact-making positions.

Each of the first and second armatures may have a surface which abuts a corresponding surface on the other of the first and second armatures when moving towards the contact-making position.

Each of the first and second armatures may comprise a pivoted lever having a first limb of ferromagnetic material on one side of the pivot and a second limb carrying at least one contact on the other side of the pivot. The or each contact may be resiliently loaded.

According to a second aspect of the invention, there is provided a controller for a contactor of the type having first and second windings, the controller having first and second output stages for driving the first and second windings, respectively, and a switchover circuit for actuating each of the first and second output stages before deactuating the other of the first and second output stages.

The contactor may be of the type according to the first aspect of the invention.

The switchover circuit may be arranged to provide a time delay of at least 20 milliseconds between actuating each of the first and second output stages and deactuating the other of the first and second output stages.

The contactor may be of the type in which each of the first and second windings comprises a pull-in winding and a hold winding and the controller may be arranged to deactuate the pull-in winding after a predetermined time period, such as 100 milliseconds, after actuation thereof.

It is thus possible to provide a contactor and a controller for providing switchover times which are sufficiently short to avoid the problems of the known arrangements described hereinbefore. Switchover times as low as 4 milliseconds may be achieved with no weight or size penalty. Such arrangements are suitable for use in aircraft power supply systems, for instance of the 200 volts AC 400 Hz type, for switching between aircraft alternators or between ground and aircraft supplies. Switchover times are sufficiently short to avoid loss of data.

The invention will be further described, by way of example, with reference to the accompanying drawings, in which:

FIG. 4 is graph of transfer time in milliseconds against delay time in milliseconds illustrating operation of the arrangement shown in FIG. 2;

FIG. 5 is a graph of armature force in relative units against time in milliseconds illustrating operation of the contactor shown in FIG. 1.

Like reference numerals refer to like parts throughout the drawings.

Figure 1:
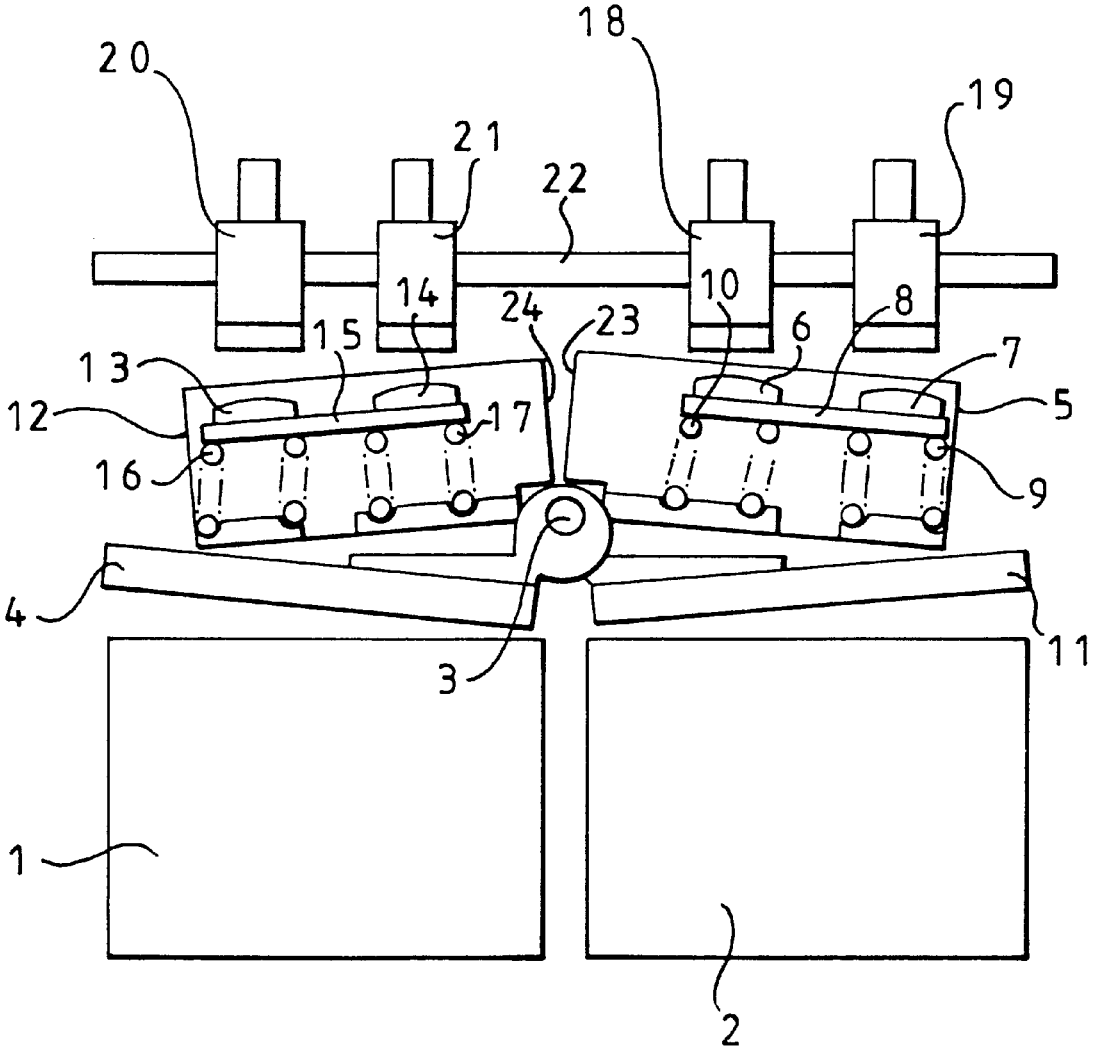
FIG. 1 is a sectional diagram of a contactor constituting a first embodiment of the invention.

The contactor shown in FIG. 1 comprises first and second windings 1 and 2. The first winding 1 cooperates with an armature in the form of a lever pivoted about a pivot 3. The lever comprises a first limb 4 of ferromagnetic material disposed on one side of the pivot 3 and a second limb 5 in the form of a contact block disposed on the other side of the pivot 3. The contact block 5 contains contacts 6 and 7 connected together by a busbar 8. The contacts are spring loaded by compression coil springs 9 and 10.

The second winding 2 similarly cooperates with an armature in the form of a pivoted lever comprising elements 11 to 17 which are identical with the elements 4 to 10, respectively, of the first armature. The armatures are spring-loaded by springs (not shown) to the positions illustrated in FIG. 1.

The moving contacts 6, 7, 13 and 14 cooperate with fixed contacts 18 to 21 which are mounted in a contact support 22. FIG. 1 shows a single pole of the contactor but the contact arrangements are triplicated so that the contactor provides changeover switching of a 3 phase AC supply.

The first and second armatures have facing surfaces 23 and 24 which define an angular gap between the armatures. During normal operation, one of the windings, such as the winding 1, is energized whereas the other winding 2 is de-energized. The ferromagnetic limb 4 is therefore pulled into contact with the winding 1 so that the whole armature moves anticlockwise. The contact block 5 thus moves towards the fixed contact support 22 so that the contacts 6 and 7 come into contact with the fixed contacts 18 and 19, respectively. An electrical connection between the contacts 18 and 19 is thus established via the busbar 8.

When the winding 1 is de-energized and the winding 2 is energized, the spring loading of the first armature tends to return it to the position illustrated in FIG. 1. In addition, the ferromagnetic limb 11 is drawn towards the winding 2 so that the contact block 12 approaches the fixed contact support 22. The surface 24 thus abuts the surface 23 and assists in displacing the contacts 6 and 7 away from the contacts 18 and 19. The angular spacing between the surfaces 23 and 24 is sufficiently small to ensure that the electrical connection between the contacts 18 and 19 is broken before a corresponding electrical connection is established between the contacts 20 and 21 via the contacts 13 and 14 and the busbar 15. The contact between the surfaces 23 and 24 reduces the changeover delay of the contactor. Further, because of the "split armature" arrangement provided by the individual first and second armatures, the amount of movement required during switchover is approximately half that which would be required in the case of a single integral armature cooperating with both windings 1 and 2 so that, again, the changeover time is reduced compared with known arrangements.

Figure 2:
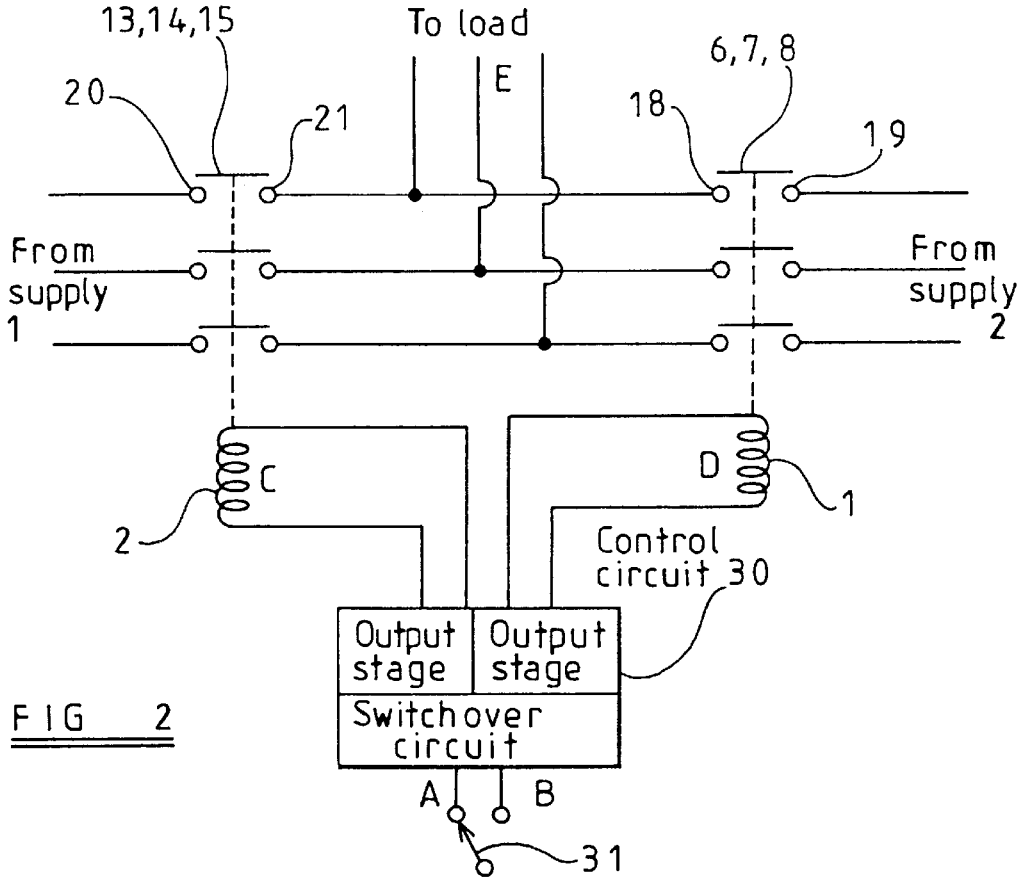
FIG. 2 is a circuit diagram of the contactor of FIG. 1 and a controller constituting a second embodiment of the invention.

FIG. 2 illustrates the use of the contactor of FIG. 1 to provide changeover between a load and first and second power supplies, for instance in an aircraft system. The three phase changeover contacts are illustrated together with a control circuit 30 which controls the supply of current to the windings 1 and 2. A switch 31 is illustrated for providing control of changeover between the power supplies. The switch 31 may be operated manually. Alternatively, the control circuit may respond to control signals supplied from other aircraft systems for changing over between the power supplies.

Figure 3:
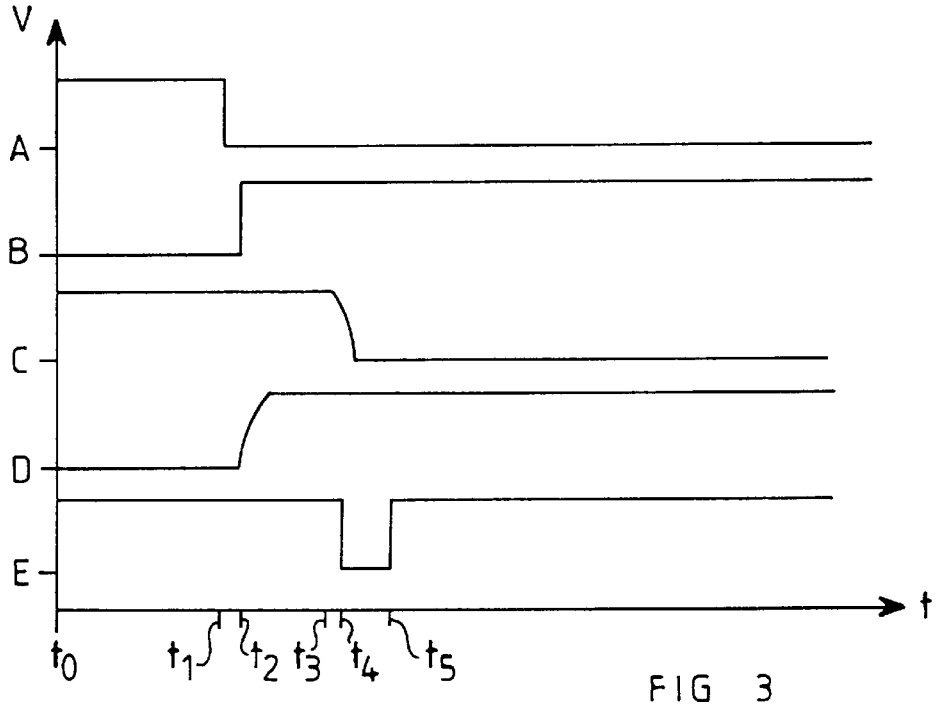
FIG. 3 is a timing diagram of the arrangement shown in FIG. 2.

FIG. 3 illustrates diagrammatically waveforms occurring during operation of the arrangement shown in FIG. 2 at circuit nodes A to E. It is assumed, at time to, that the winding 2 is energized by the control circuit with the switch 31 connecting to the circuit node A so that the contacts 13 and 14 are in contact with the contacts 20 and 21, respectively. The gap between the surfaces 23 and 24 is almost closed but with a residual gap remaining to accommodate manufacturing tolerances. The waveform E illustrates diagrammatically the envelope of the AC power supplied to the load.

At time $t_1$, the switch 31 is operated so as to remove the signal from the node A. After a short delay at time $t_2$, the moving contact of the switch 31 makes contact with the circuit node B so as to initiate changeover from power supply 1 to power supply 2. The control circuit 30 energises the winding 1 as shown by waveform D but the control circuit continues to energise the winding 2. The ferromagnetic limb 4 of the first armature is urged towards the winding 1 against the influence of the spring loading and closes the residual gap between the surface 23 and the surface 24.

After a time delay represented by the time period between the times $t_2$ and $t_3$, the control circuit 30 de-energises the winding 2 so that the winding 2 ceases to attract the ferromagnetic limb 11 of the second armature. After a short time delay between the times $t_3$ and $t_4$, the force exerted by the first armature through the contact between the surfaces 23 and 24 and the spring loading causes the moving contacts 13 and 14 to be moved away from the fixed contacts 20 and 21 so as to break the connection from the first power supply to the load. At time $t_5$, the moving contacts 6 and 7 come into contact with the fixed contacts 18 and 19 so as to complete the changeover to the second power supply.

FIG. 4 illustrates the changeover performance of the arrangement shown in FIG. 2 as transfer time i.e. the time period between $t_4$ and $t_5$, against delay time i.e. the time period between $t_2$ and $t_3$. For positive delay times i.e. de-energizing one winding before re-energizing the other winding, the transfer times are relatively high. For zero delay time such that energisation of one winding is simultaneous with de-energisation of the other winding, the changeover or transfer time is approximately 18 milliseconds and is therefore substantially less than transfer times for known contactors. However, for negative delay times such that each coil is energized before the other coil is de-energized, the transfer times are substantially less and tend towards a minimum transfer time of 4 milliseconds for delay times of −20 milliseconds. This represents a very rapid changeover which improves on the transfer times of known contactors by an order of magnitude. It is therefore possible to provide a contactor and control arrangement which have no weight and size penalty but which achieve very rapid changeover times.

The graphs in FIG. 5 illustrate operation of the contactor shown in FIG. 1 for delay times of zero and −20 milliseconds. The vertical axis represents the force or torque on the armatures as a proportion of the normal holding torque or force. The broken line graph 40 represents the force acting on the armature of the "drop-out coil" i.e. the armature cooperating with the winding which is being de-energized at time zero. The curves 41 and 42 illustrate the force acting on the armature of the "pull-in coil" i.e. the coil which is actuated at times zero and −20, respectively.

Each of the curves 41 and 42 crosses the curve 40 at the point where the forces on the armatures balance each other. This occurs earlier for the curve 42 than for the curve 41, illustrating that energizing the pull-in coil before de-energizing the drop-out coil allows a faster changeover or transfer time.

Figure 6:
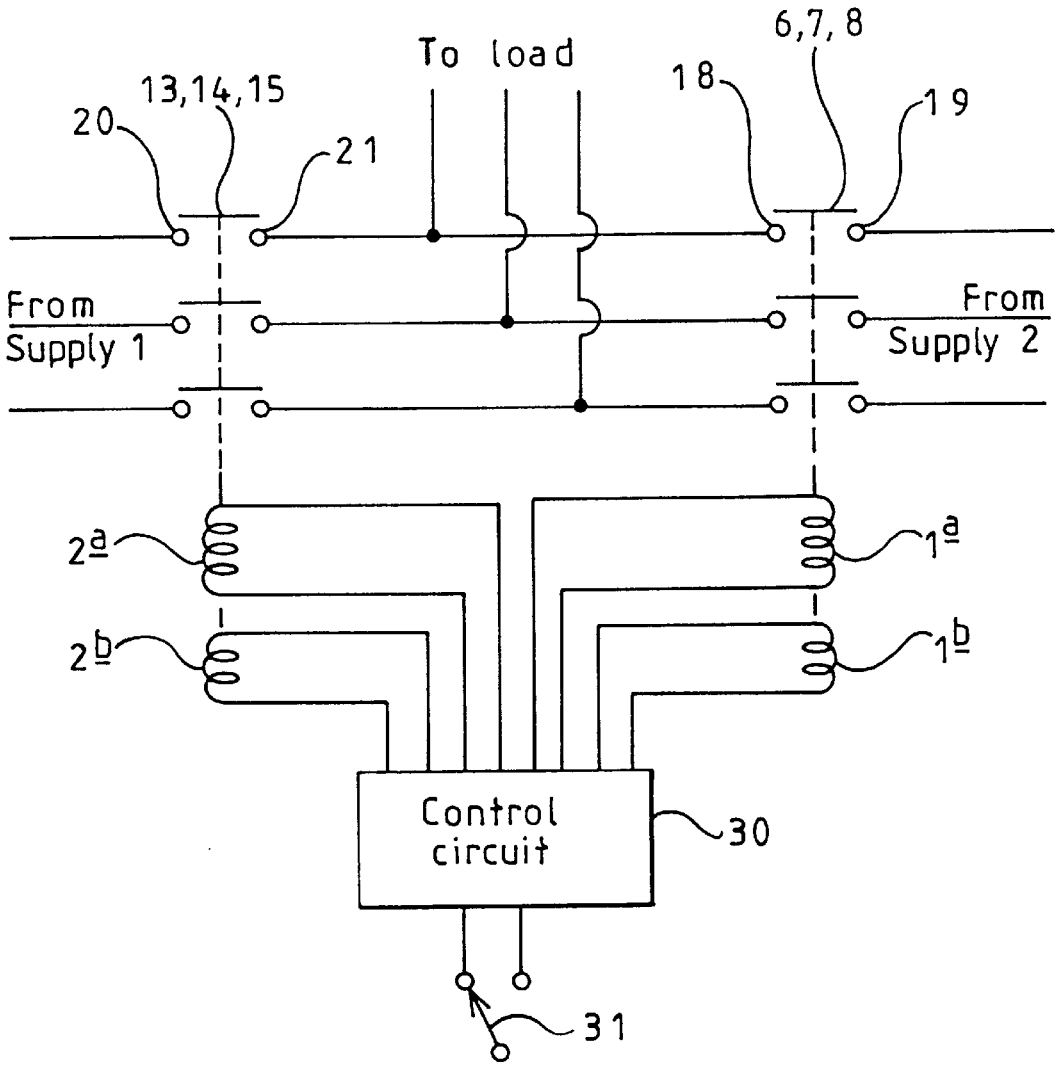
FIG. 6 is a circuit diagram of another contactor and control arrangement constituting a further embodiment of the invention.

FIG. 6 illustrates an arrangement which differs from that shown in FIG. 2 in that the windings 1 and 2 are replaced by pull-in windings 1*a* and 2*a*, respectively, and hold windings 1*b* and 2*b*, respectively. The control circuit 30 differs from that shown in FIG. 1 in that, in order to energise, for instance, the winding arrangement represented by the windings 1*a* and 1*b*, either the winding 1*a* alone is energized or both windings 1*a* and 1*b* are energized. After a predetermined time period from initial energisation, such as 100 milliseconds, the pull-in winding 1*a* is de-energized whereas the hold winding 1*b* is energized or continues to be energized so as to hold the contacts 6 and 8 against the fixed contacts 18 and 19.

By energizing the pull-in winding 1*a* or both windings 1*a* and 1*b* simultaneously, the force exerted on the corresponding armature is sufficiently high to ensure rapid changeover. However, after changeover has occurred, a reduced magnetic force is required to maintain the contacts in the desired positions. The current consumption and power dissipation within the contactor are thus reduced by supplying a smaller current through the hold winding 1*b*.

Operation of the windings 2*a* and 2*b* is the same.

It is thus possible to reduce current consumption and power dissipation without otherwise effecting operation of the arrangement. By energizing the pull-in windings 1*a*, 2*a* for a predetermined time period, switching arrangements for controlling energisation of the pull-in windings are unnecessary.

What is claimed is:

1. A switching system comprising in combination, a contactor and a controller for the contactor, the contactor comprising first and second armatures, each of which has a respective contact-making position, and first and second windings for urging said first and second armatures, respectively, towards said respective contact-making positions, each one of said first and second armatures being operable to displace the other of the first and second armatures away from its respective contact-making position when said each one of said first and second armatures is urged by a respective one of said first and second windings to its respective contact-making position, and, the controller comprising first and second output stages for driving said first and second windings respectively, and a switch over circuit for actuating each of said first and second output stages before de-actuating each other of said first and second output stages.

2. A switching system as claimed in claim 1, in which said switchover circuit actuates said each of said first and second output stages at least 20 milliseconds before deactuating said each other of said first and second output stages.

3. A switching system as claimed in claim 1, in which said contactor is of a type in which each of said first and second windings comprises a pull-in winding and a hold winding, said controller deactuating each of said pull-in windings after a predetermined time period following an actuation of said each of said pull-in windings.

* * * * *